US011832709B2

(12) United States Patent
Pritchett-El

(10) Patent No.: US 11,832,709 B2
(45) Date of Patent: Dec. 5, 2023

(54) MULTIFUNCTIONAL MAKEUP APPLICATOR

(71) Applicant: Dominique Pritchett-El, Plainfield, IL (US)

(72) Inventor: Dominique Pritchett-El, Plainfield, IL (US)

( * ) Notice: Subject to any disclaimer, the term of this patent is extended or adjusted under 35 U.S.C. 154(b) by 377 days.

(21) Appl. No.: 17/170,308

(22) Filed: Feb. 8, 2021

(65) Prior Publication Data

US 2021/0244159 A1 Aug. 12, 2021

Related U.S. Application Data

(60) Provisional application No. 62/971,631, filed on Feb. 7, 2020.

(51) Int. Cl.
*A45D 40/24* (2006.01)
*A45D 40/20* (2006.01)
*A45D 40/26* (2006.01)

(52) U.S. Cl.
CPC ..... *A45D 40/24* (2013.01); *A45D 40/20* (2013.01); *A45D 40/267* (2013.01)

(58) Field of Classification Search
CPC .. B65D 21/0228; A45D 34/046; A45D 40/20; A45D 40/24; A45D 40/267
USPC ..... 206/385, 509, 581; 401/17, 19, 20, 401/126–130
See application file for complete search history.

(56) References Cited

U.S. PATENT DOCUMENTS 6,568,529 B2 * 5/2003 McMurrey ..... B65D 21/0228 206/385
8,506,194 B2 * 8/2013 Liu ..... A45D 40/24 401/175
8,662,775 B1 * 3/2014 Liu ..... A45D 40/262 401/23
11,109,658 B1 * 9/2021 Khodzhayan ..... A45D 34/041
2004/0258452 A1 * 12/2004 Shyu ..... B43K 27/04 401/18
2008/0145133 A1 * 6/2008 Palmer ..... B65D 21/0231 401/18
2012/0315073 A1 * 12/2012 Spirko ..... A45D 34/041 401/17
2013/0114991 A1 * 5/2013 Liu ..... A45D 34/042 401/172

* cited by examiner

*Primary Examiner* — Luan K Bui
(74) *Attorney, Agent, or Firm* — K&L Gates LLP

(57) ABSTRACT

A multifunctional makeup tool includes a cap, a first portion that includes a first body, a second portion including a second body and a second cap, and a third portion including a third body. The first body includes a lower first surface, the second cap includes a second upper surface, and the second body includes a lower second surface. The third body includes an upper third surface. The lower first surface of the first body engages with the second upper surface of the second cap, and the lower second surface of the second body engages with the upper surface of the third body. Each of the first product, the second product, and the third product comprises a first cosmetic material, a second cosmetic material, and a third cosmetic material.

13 Claims, 4 Drawing Sheets

MULTIFUNCTIONAL MAKEUP APPLICATOR

CROSS-REFERENCE TO RELATED APPLICATIONS

This application incorporates by reference and claims the benefit of priority to U.S. Provisional Application No. 62/971,631 filed Feb. 7, 2020.

BACKGROUND OF THE INVENTION

The present subject matter relates generally to a multifunctional makeup applicator. More specifically, the present invention relates to a makeup applicator having a pen-shaped housing and including various cosmetics and tools for applying such cosmetics.

Makeup consumers typically use a variety of cosmetics to complete their appearance or desired look. Common basic cosmetics used on a daily basis include foundation, blush, eyeliner, and mascara, often in varying degrees based on the day's activities. Users commonly apply makeup at the beginning of the day and reapply makeup as needed throughout the day as makeup tends to wear off over time. Many people often wear one set of makeup during the day, and then switch to a different style or look for the evening, requiring a new application of makeup.

In order to maintain these looks, people wearing makeup often keep cosmetics in their day bags, at the office, in the car, and/or in their gym bags. In each location, the user must keep the basic components needed to complete the look. Many consumers also switch bags throughout the week, adding an extra step of remembering which cosmetics are located in which bags. Maintenance of the desired look ultimately requires the management and purchasing of many makeup tools.

The solutions available for streamlining the makeup tools management process are quite limited. Some consumers keep a single set of makeup tools in a small makeup bag that can be easily moved between larger purses or travel bags. Some consumers purchase multiple items of a single product in order to keep one mascara at the office and another mascara in the car, etc. These systems include a number of weak points, such as losing track of the makeup bag in the midst of the day's movement or forgetting the makeup bag before leaving the house for the day. Another problem is running out of one of the multiple makeup items but consistently forgetting to replace it since the others have not yet run out.

Accordingly, there is a need for a singular makeup applicator that integrates a number of cosmetics and makeup tools into a convenient device, as described herein.

BRIEF SUMMARY OF THE INVENTION

To meet the needs described above and others, the present disclosure provides a multifunctional makeup applicator featuring a variety of tools as a convenient, all-in-one solution for the basic beauty needs. By providing a singular tool that includes various makeup components, tools, and cosmetics, the multifunctional makeup applicator described herein is an easy-to-use solution that eliminates the need to purchase multiple items in order to have the same item in different locations, such as at work, at home, or at the gym. It also eliminates the need to pack a variety of makeup products needed throughout the day into the user's purse or bag on a daily basis. For consumers who need to refresh makeup over a long day at the office or intend to dress for a dinner date after a yoga class, the user can simply keep the makeup applicator in a purse or travel bag, instead of needing to remember to pack the individual components.

In the embodiment illustrated herein, the makeup applicator includes a cap, a first portion that houses a first product within a first body, a second portion that houses a second product within a second body and a second cap that rests atop the second body, and a third portion that houses a third product within a third body, the bodies of which connect together. More specifically, a lower first surface of the first body engages with the second cap, and a lower second surface of the second body engages with an upper surface of the third body. The first, second, and third portions engage with one another to form the multifunctional makeup applicator, and may be separated from one another.

Each of the first product, the second product, and the third product comprises a first cosmetic material, a second cosmetic material, and a third cosmetic material. In the examples described herein the first, second, and third products are hair product, mascara, and eyeliner, although any other suitable cosmetic product can be used instead of the exemplary products described below.

In one example, the first product is a pomade or other hair product, although other products such a lip cream, a moisturizer, or a foundation may be used. The first body has a hollow, cylindrical shape and includes a first upper surface with exterior threads and a first lower surface. A product cup is positioned within the first body through a friction fit, although other means of securing may be used. The product cup has a cylindrical shape and includes an external lip along the perimeter thereof at a distance from a top surface of the product cup. The external lip rests against the first upper surface of the first body. The cap is positioned atop the first body, and includes internal threading near a lower surface that engages with the external threading of the first body.

In other embodiments, the product cup may include a mechanical brow pencil, a lipstick, or other product that extends upwardly from a bottom surface of the cup. In such embodiments, the cosmetic product may move between an extended position and a withdrawn position utilizing a twisting, rotational movement as is common in the industry.

A clip extends from an outer surface of the cap and extends along the length of the multifunctional makeup applicator. A user may then attach the makeup application onto a pocket, a piece of clothing, a surface of a bag. The clip may optionally include a spoolie brush enclosed by a removable cap on an outer end thereof.

In some embodiments, the second portion houses an eyelash product, such as mascara or eyelash glue, along with tools for applying the eyelash product. The second portion includes a second body having a cylindrical shape and includes a second body upper surface with interior threads and a second lower surface with exterior threads. In some embodiments, a cylindrical wall of the second body includes a taper toward the lower surface such that the upper surface has a greater diameter than the diameter of the lower surface. A second body cap rests atop the second body upper surface of the second body and threadingly engages with the first lower surface of the first body.

A mascara rod, a mascara wiper, and a mascara bottle are positioned within the second body. The mascara bottle has a cylindrical shape that is sized to fit within the second body; in one embodiment, the mascara bottle tapers toward a lower surface thereof to match the taper of the mascara body. At an upper surface of the mascara bottle, external threading leads to a flanged surface.

A mascara wiper is positioned within an upper opening of a mascara bottle. The wiper has a cylindrical shape to complement the interior of the mascara bottle, and an outwardly extending lip that rests atop an upper surface of the mascara bottle. The mascara wiper also includes an orifice through which the mascara rod, more specifically the spoolie positioned thereon, is inserted.

The mascara rod includes a mascara rod handle, having a cylindrical shape with internal threading for threading onto the external threading of the mascara bottle. The mascara rod handle includes a planar surface from which the mascara rod extends. When the mascara rod handle is connected to the mascara bottle, the lip of the mascara wiper is seated against the planar surface about the rod, with the rod extending through the wiper into the mascara bottle. The second body cap receives within it the mascara rod handle as it rests atop the second body.

In some embodiments, the third portion houses an eyeliner product, although other products such as a lipstick or brow pencil may be used. The third portion includes a third body is secured to the second lower surface of the second body. The eyeliner or other cosmetic product is positioned within a length of the third body such that an eyeliner tip extends from a lower end of the third body.

The second body includes internal threading spaced from the second lower surface of the second body as well as external threading adjacent to the second lower surface of the second body. The third body has a generally cylindrical shape that includes an externally threaded portion adjacent to a third upper surface. The external threaded portion of the third body engages with the internal threading near the second lower surface of the second body.

The third body also includes smooth portion that is seated up against the second body during use. The smooth portion of the third body tapers toward a point through which the eyeliner tip extends therefrom.

The third portion also includes a bottom cap that fits about the eyeliner tip and the third body. The bottom cap has internal threading along an upper surface thereof that engages with the external threading on the second lower surface of the second body.

An object of the invention is to provide an easy-to-use tool for basic makeup needs.

An advantage of the invention is that the single makeup applicator device is an easy-to-grab solution to be moved from bag to bag or location to location throughout the day.

A further advantage of the invention is that it reduces the chances of remembering to bring one cosmetic product while forgetting another.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

Figure 1:
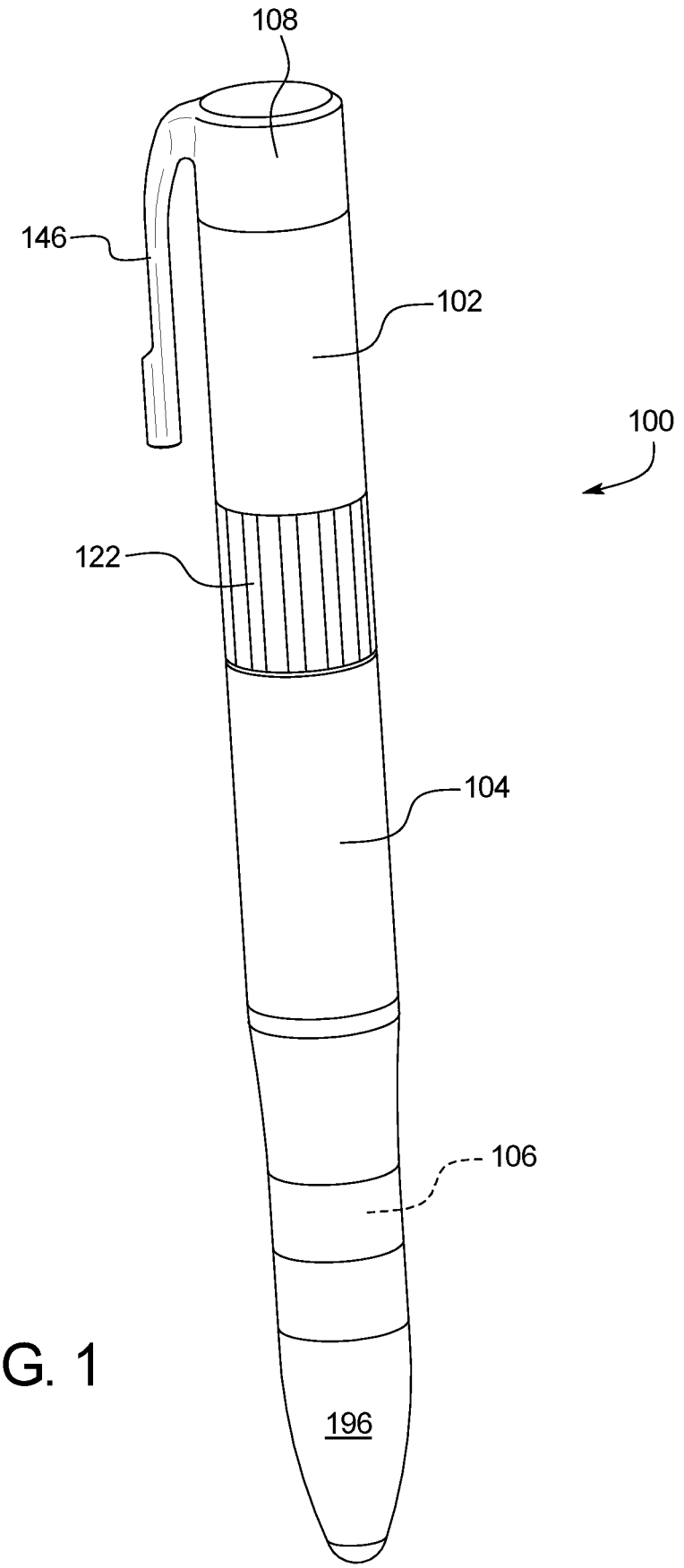
FIG. 1 is a perspective view of a multifunctional makeup applicator of the present application.
Figure 2:
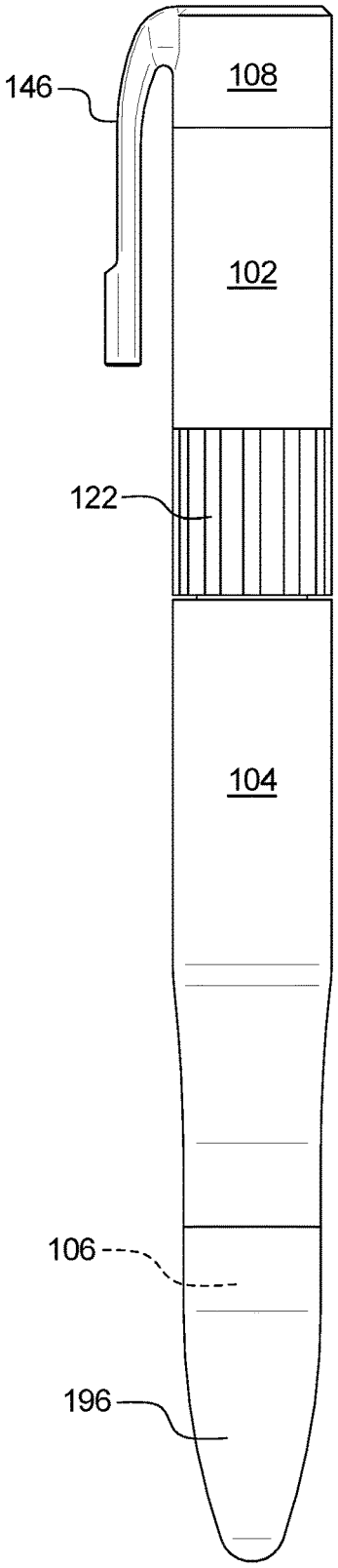
FIG. 2 is a front elevational view of the multifunctional makeup applicator of FIG. 1.
Figure 3:
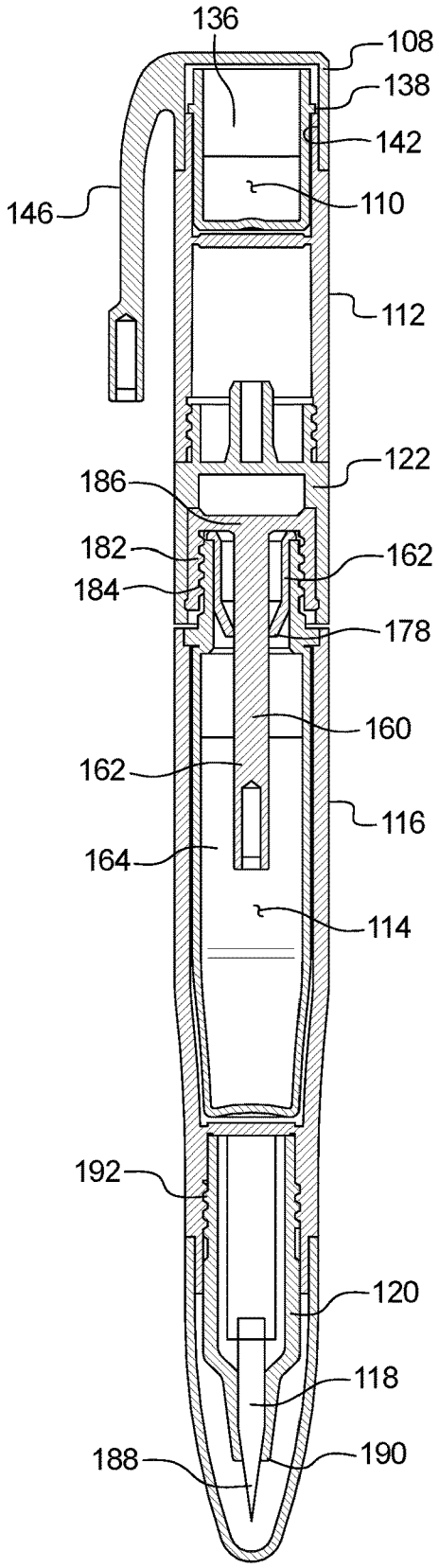
FIG. 3 is a cross sectional view of the multifunctional makeup applicator of FIG. 1 taken along lines 3-3 of FIG. 2.
Figure 4:
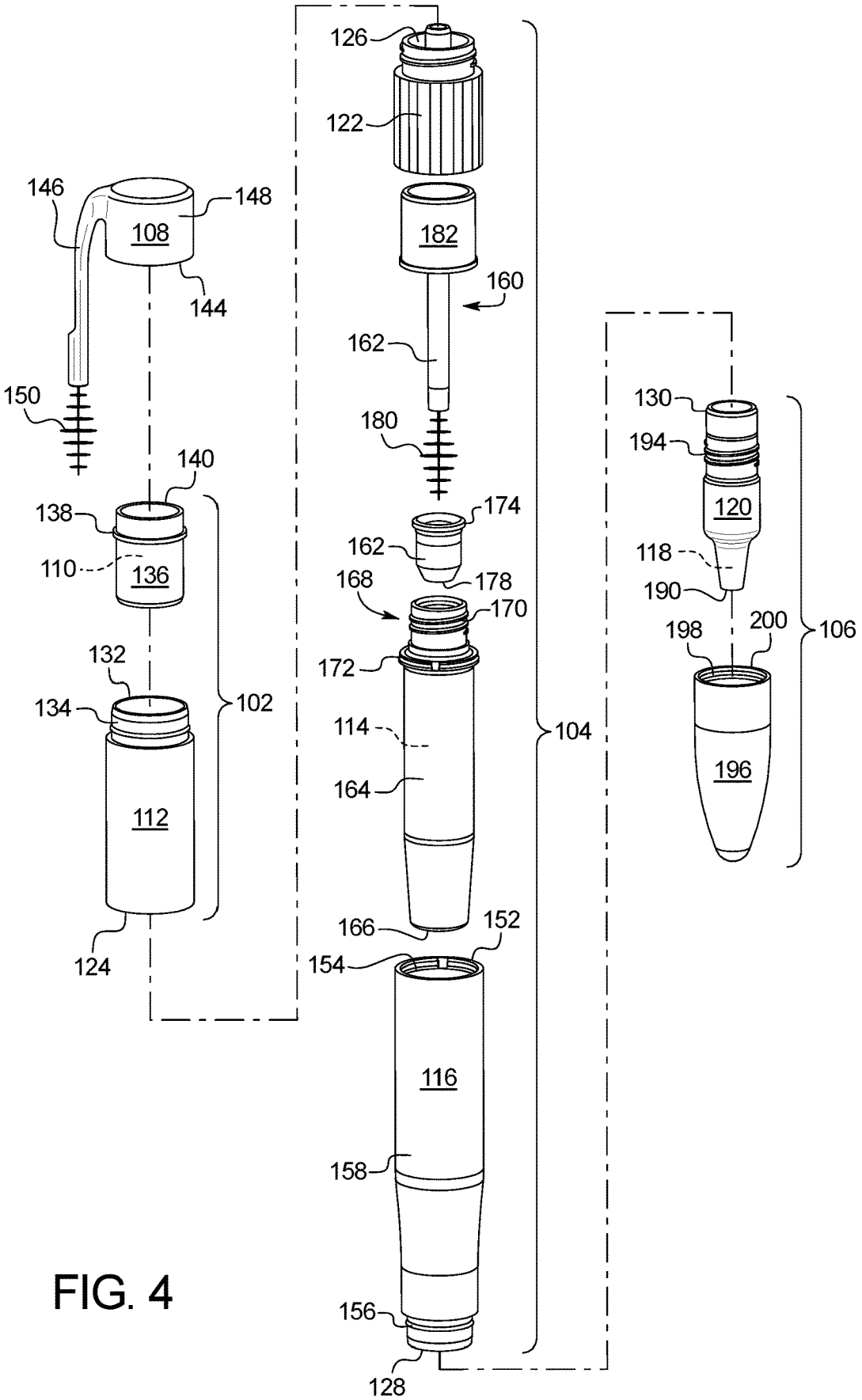
FIG. 4 is an exploded, perspective view of the multifunctional makeup applicator of FIG. 1.
Figure 5:
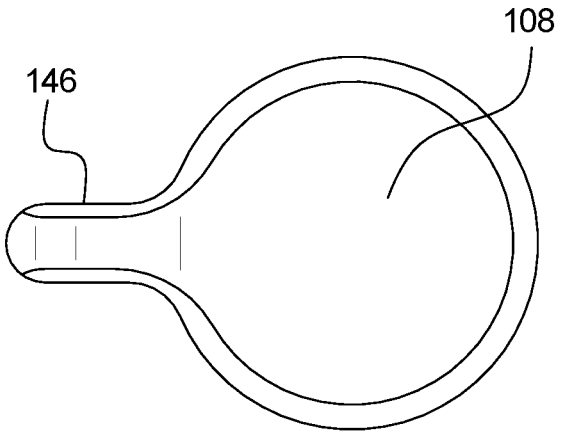
FIG. 5 is a plan view of the multifunctional makeup applicator of FIG. 1.
Figure 6:
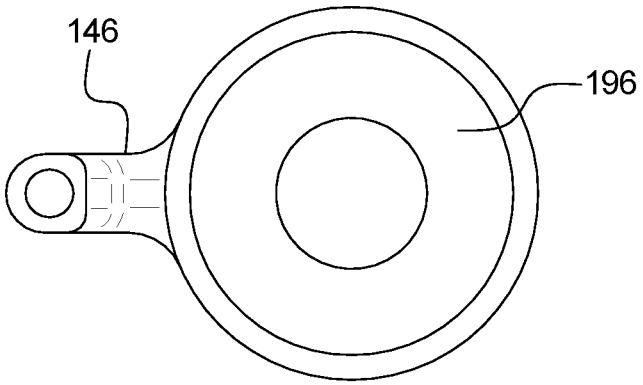
FIG. 6 is a bottom plan view of the multifunctional makeup applicator of FIG. 1.

FIGS. 1-6 illustrate an example of a multifunctional makeup applicator 100. The applicator 100 includes first, second, and third portions 102, 104, 106 that engage together to form a pen shape, but that can be separated in order to be used.

In the embodiment illustrated herein, the makeup applicator 100 includes a cap 108, a first portion 102 that houses a first product 110 within a first body 112, a second portion 104 that houses a second product 114 within a second body 116, and a third portion 106 that houses a third product 118 within a third body 120. The second portion 104 also includes a second cap 122 for the second body 116, and the bodies 112, 116, 120 and second cap 122 connect together.

More specifically, the first body 112 includes a lower first surface 124, the second cap 122 includes a second upper surface 126, the second body 116 includes a lower second surface 128, and the third body 120 includes an upper third surface 130. The lower first surface 124 of the first body 112 engages with the second upper surface 126 of the second cap 122, the second cap 122 engages the second body 116, and the lower second surface 128 of the second body 116 engages with the upper surface 130 of the third body 120. The first, second, and third portions 102, 104, 106 engage with one another to form the multifunctional makeup applicator 100, and may be separated from one another during use. Further, while components described herein are connected through a threaded engagement or a friction fit, any type of engagement may be used in lieu of one another as desired or required by manufacturing.

Each of the first product 110, the second product 114, and the third product 118 comprises a first cosmetic material, a second cosmetic material, and a third cosmetic material. In the following example, the first, second, and third products comprise a pomade or hair product, an eyelash product, and an eyeliner product, and it should be recognized that other products may be switch out and used interchangeably with those described herein.

In one example, the first product 110 is a pomade or other hair product, although other products such a lip cream, a moisturizer, or a foundation may be used. The first body 112 has a hollow, cylindrical shape and includes a first upper surface 132 with exterior threads 134 and the first lower surface 124. A product cup 136 is positioned within the first body 112 through a friction fit, although other means of securing may be used. The product cup 136 has a cylindrical shape and includes an external lip 138 along the perimeter thereof at a distance from a top surface 140 of the product cup 136. The external lip 138 rests against the first upper surface 132 of the first body 112. The cap 108 is positioned atop the first body 112, and includes internal threading 142 near a lower surface 144 that engages with the external threading 134 of the first body 112.

In other embodiments, the product cup 136 includes a mechanical brow pencil, a lipstick, or other product that extends upwardly from a bottom surface of the cup 136. In such embodiments, the cosmetic product may move between an extended position and a withdrawn position utilizing a twisting, rotational movement as is common in the industry.

In some embodiments, a clip 146 extends from an outer surface 148 of the cap 108 and extends along the length of the multifunctional makeup applicator 100. A user may then attach the makeup applicator 100 onto a pocket, a piece of clothing, a surface of a bag, similar to the use of a clip on a pen cap. The clip 146 may include a spoolie brush 150 enclosed by a removable cap on an outer end thereof. The spoolie brush 150 may be used to brush the eyebrows into place, to separate eyelashes, and/or to remove clumps of mascara. In other embodiments, the clip 146 may extend from the first body 112.

In some embodiments, the second portion 104 houses an eyelash product 114, such as mascara or eyelash glue, along with tools for applying the eyelash product. The second body 116 has a cylindrical shape and includes a second body upper surface 152 with interior threads 154 and the second lower surface 128 with exterior threads 156. In some embodiments, a cylindrical wall 158 of the second body 116 includes a taper toward the lower surface 128 such that the upper surface 154 has a greater diameter than the diameter of the lower surface 128. The second body cap 122 rests atop the second body upper surface 154 of the second body 116 and threadingly engages with the first lower surface 124 of the first body 112.

A mascara rod 160, a mascara wiper 162, and a mascara bottle 164 are positioned within the second body 116. The mascara bottle 164 has a cylindrical shape that is sized to fit within the second body 116; in one embodiment, the mascara bottle 164 tapers toward a lower surface 166 thereof to match the taper of the mascara body 116. At an upper surface 168 of the mascara bottle 164, external threading 170 leads to a flanged surface 172.

The mascara wiper 160 is positioned within the upper surface 168 of a mascara bottle 164. The wiper 162 has a cylindrical shape to complement the interior of the mascara bottle 164, and an outwardly extending lip 174 that rests atop the upper surface 168 of the mascara bottle 164. A lower surface 176 of the mascara wiper 162 forms an orifice 178 through which the mascara rod 162, more specifically the spoolie 180 positioned thereon, is inserted.

The mascara rod 162 includes a mascara rod handle 182, having a cylindrical shape with internal threading 184 for threading onto the external threading 170 of the mascara bottle 164. The mascara rod handle 182 includes a planar surface 186 from which the mascara rod 162 extends. When the mascara rod handle 186 is connected to the mascara bottle 164, the lip 174 of the mascara wiper 162 is seated against the planar surface 186 about the rod 160, with the rod 160 extending through the wiper 162 into the mascara bottle 164. The second body cap 122 receives within it the mascara rod handle 182 as it rests atop the second body 116.

In some embodiments, the third portion 106 houses an eyeliner product 118, although other products such as a lipstick or brow pencil may be used. The third body 120 is secured to the second lower surface 128 of the second body 116. The eyeliner or other cosmetic product is positioned within a length of the third body 120 such that an eyeliner tip 188 (see FIG. 3) extends from a lower end 190 of the third body 120.

The second body 116 includes internal threading 192 spaced from the second lower surface 128 of the second body 116 as well as external threading 156 adjacent to the second lower surface 128 of the second body 116. The third body 120 has a generally cylindrical shape that includes external threads 194 adjacent to the third upper surface 130. The external threaded portion 130 of the third body 120 engages with the internal threading 192 near the second lower surface 128 of the second body 116. The cylindrical body of the third body 120 tapers toward a point 190 through which the eyeliner tip 188 extends therefrom.

The eyeliner product 118 is held in position through a friction fit or other suitable means, and can be moved through the point 190 by manually moving the product 118 through the third body 120. In other embodiments, the third body 120 includes additional components that allow for the eyeliner product 118 to be moved through the third body 120 and the point 190 via mechanical means, such as but not limited to rotation, a spring mechanism, or grooves and shouldered tabs.

The third portion 120 also includes a bottom cap 196 that fits about the eyeliner tip 188 of the eyeliner product 118 and the third body 120. The bottom cap 196 has internal threading 198 along an upper surface 200 thereof that engages with the external threading 156 on the second lower surface 128 of the second body 116. In an alternative embodiment, the eyeliner product 118 can be withdrawn into the third body 120 during periods of non-use, and the bottom cap 196 would not be necessary.

It should be noted that various changes and modifications to the presently preferred embodiments described herein will be apparent to those skilled in the art. Such changes and modifications may be made without departing from the spirit and scope of the present invention and without diminishing its attendant advantages.

I claim:

1. A multifunctional makeup tool comprising:

a pen-shaped housing including:

a first portion including the first body, wherein the first body includes a lower first surface;

a second portion including a second body and a second cap, wherein the second cap includes a second upper surface and the second body includes a lower second surface; and a third portion including a third body, wherein the third body includes an upper third surface;

wherein the lower first surface of the first body engages with the second upper surface of the second cap, and wherein the lower second surface of the second body engages with the upper surface of the third body; and a cap that engages with the first portion, wherein the cap includes a clip extending along a length of the pen-shaped housing;

a bottom cap that engages with the third portion;

wherein each of the first portion, the second portion, and the third portion comprises a first cosmetic material, a second cosmetic material, and a third cosmetic material, respectively.

2. The multifunctional makeup tool of claim 1, wherein each of the first body, the second body, and the third body has a cylindrical shape.

3. The multifunctional makeup tool of claim 1, wherein the first portion further comprises a product cup that is received within the first body.

4. The multifunctional makeup tool of claim 1, wherein the second portion further comprises a mascara bottle and a mascara rod, wherein the mascara rod includes a mascara handle.

5. The multifunctional makeup tool of claim 1, wherein each of the first, second, and third cosmetic materials comprises one of the following:

a pomade, a hair product, a lipstick, a lip gloss, a mascara, a lash glue, an eyeliner, a brow pencil, and moisturizer.

6. The multifunctional makeup tool of claim 1, further comprising a clip extending from the first body, wherein the clip includes a spoolie brush.

7. A multifunctional makeup tool comprising:

a first cap that engages a top surface of a first body;

a first portion including the first body;

a second portion including a mascara bottle, a mascara wiper positioned within an upper opening of the mascara bottle, a mascara rod having a mascara rod handle that engages with the upper opening of the mascara bottle and a mascara rod body that positioned within the mascara bottle, a mascara body that houses the mascara bottle, the mascara wiper, and the mascara rod body, and a second cap that is positioned about the mascara rod head and engages with a lower end of the first body and the upper opening of the mascara bottle; and a third portion including a third body and a third cap, wherein the third cap engages with a bottom opening of the mascara body.

8. The multifunctional make-up tool of claim 7, wherein the first portion further comprises a product cup housed within the first body.

9. The multifunctional make-up tool of claim 8, wherein the first portion further comprises one of a brow pencil and a lipstick within the product cup.

10. The multifunctional make-up tool of claim 7, wherein the mascara bottle contains one of mascara and eyelash glue.

11. The multifunctional make-up tool of claim 7, wherein an eyeliner is positioned within the third body, and wherein the eyeliner comprises one of a marker type eyeliner and a cream based pencil.

12. The multifunctional make-up tool of claim 7, further comprising a clip extending from the first cap and including a spoolie brush.

13. A multifunctional make-up tool comprising:

a first portion including a product cup housed within a first body and a first cap that engages a top of the first body;

a second portion including a mascara wiper positioned within an upper opening of a mascara bottle, a mascara rod having a mascara rod head that engages with the upper opening of the mascara bottle and a mascara rod body that is positioned within the mascara bottle, a mascara body that houses the mascara bottle, the mascara wiper, and the mascara rod body, and a mascara cap that is positioned about the mascara rod head and engages with a lower end of a pomade body and the upper opening of the mascara bottle; and a third portion including a third body moveable within a third cap, wherein an eyeliner is positioned within the third body, and wherein the third cap engages with a bottom opening of the mascara body.

* * * * *